US011446785B2

(12) United States Patent
Chang et al.

(10) Patent No.: US 11,446,785 B2
(45) Date of Patent: Sep. 20, 2022

(54) METHODS TO CLEAN CHEMICAL MECHANICAL POLISHING SYSTEMS

(71) Applicant: TAIWAN SEMICONDUCTOR MANUFACTURING CO., LTD., Hsinchu (TW)

(72) Inventors: Chih-Chieh Chang, Zhubei (TW); Yen-Ting Chen, Taipei (TW); Hui-Chi Huang, Zhubei (TW); Kei-Wei Chen, Tainan (TW)

(73) Assignee: TAIWAN SEMICONDUCTOR MANUFACTURING CO., LTD., Hsinchu (TW)

( * ) Notice: Subject to any disclaimer, the term of this patent is extended or adjusted under 35 U.S.C. 154(b) by 369 days.

(21) Appl. No.: 16/584,874

(22) Filed: Sep. 26, 2019

(65) Prior Publication Data

US 2020/0130138 A1 Apr. 30, 2020

Related U.S. Application Data

(60) Provisional application No. 62/753,860, filed on Oct. 31, 2018.

(51) Int. Cl.
*B24B 53/017* (2012.01)
*B24B 37/20* (2012.01)

(52) U.S. Cl.
CPC ..... *B24B 53/017* (2013.01); *B24B 37/20* (2013.01)

(58) Field of Classification Search
CPC ... B24B 53/017; B24B 53/095; B24B 53/001; B24B 53/02; B24B 37/20; B24B 37/10; B24B 37/105; B24B 7/228
USPC ..... 451/56
See application file for complete search history.

(56) References Cited

U.S. PATENT DOCUMENTS

2007/0135024 A1* 6/2007 Kobata ..... B24B 37/26 451/526

* cited by examiner

*Primary Examiner* — Joseph J Hail
*Assistant Examiner* — Caleb Andrew Holizna
(74) *Attorney, Agent, or Firm* — Seeed IP Law Group LLP

(57) ABSTRACT

Provided herein are chemical-mechanical planarization (CMP) systems and methods to reduce metal particle pollution on dressing disks and polishing pads. Such methods may include contacting a dressing disk and at least one conductive element with an electrolyte solution and applying direct current (DC) power to the dressing disk and the at least one conductive element.

20 Claims, 9 Drawing Sheets

METHODS TO CLEAN CHEMICAL MECHANICAL POLISHING SYSTEMS

PRIORITY CLAIM AND CROSS-REFERENCE

This application claims the benefit of U.S. Provisional Patent Application No. 62/753,860, filed Oct. 31, 2018, which is incorporated by reference herein.

BACKGROUND

Chemical Mechanical Polishing (CMP) is a common practice in the formation of integrated circuits. Typically, CMP is used for the planarization of semiconductor wafers. CMP takes advantage of the combined effect of both physical and chemical forces for the polishing of wafers. It is performed by applying a load force to the back of a wafer while the wafer rests on a polishing pad. The polishing pad and the wafer are then counter-rotated while a slurry containing abrasives and/or reactive chemicals is passed therebetween. CMP is an effective way to achieve global planarization of wafers.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1A:
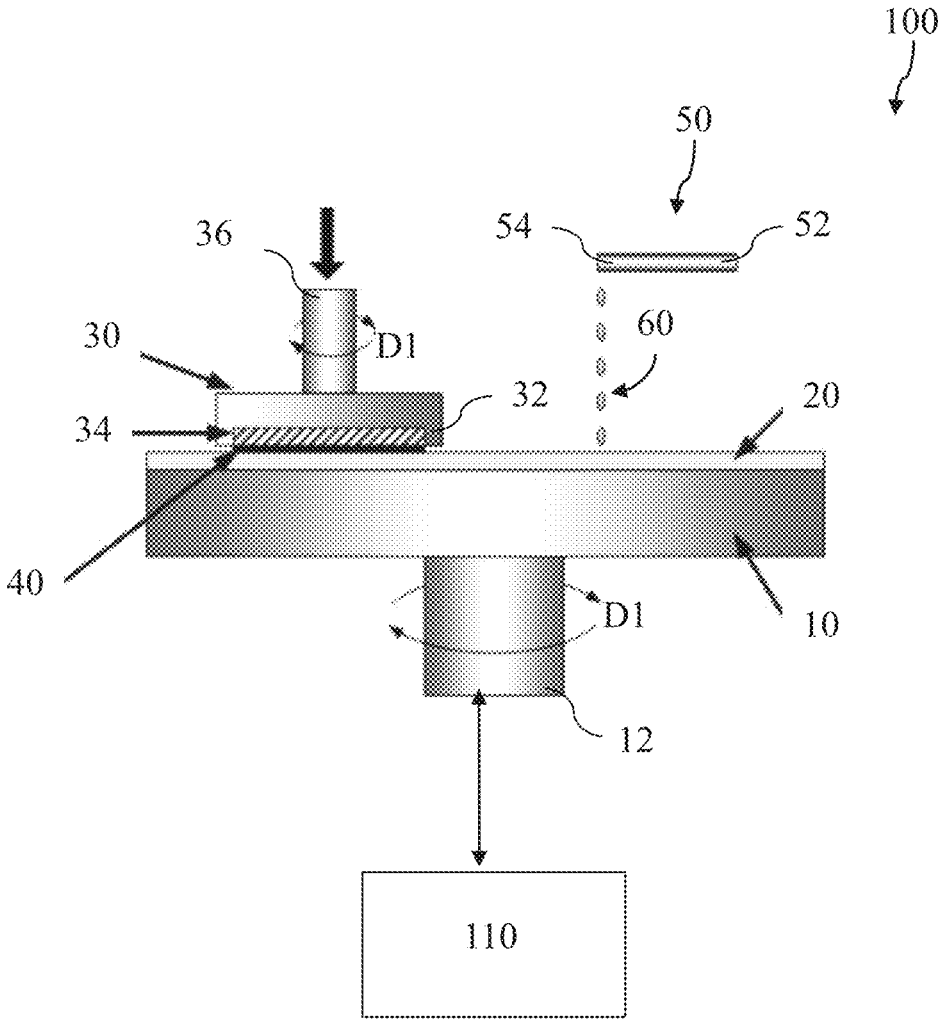
FIGS. 1A and 1B are diagrams of a chemical mechanical polishing (CMP) system in accordance with some embodiments.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Methods of the present disclosure reduce metal particle pollution on dressing disks and polishing pads in chemical-mechanical planarization (CMP) systems, in accordance with various exemplary embodiments. Embodiments of the present disclosure also include the scope of using the methods in accordance with various embodiments in the process of manufacturing integrated circuits. For example, methods include using the CMP systems herein to planarize wafers, on or in which integrated circuits are formed.

FIG. 1A schematically illustrates a perspective view of a CMP system 100. The CMP system 100 includes a platen 10, a polishing pad 20 on top of the platen 10, and a wafer carrier 30 configured to support a wafer 40 for processing using the CMP system 100. The CMP system 100 further includes a slurry delivery system 50 configured to deliver a slurry 60 to the polishing pad 20 to facilitate removal of metals or non-metal features from the wafer 40. A control system 110 is configured to control operation of the CMP system 100. The CMP system 100 further includes a dressing disk (not shown) configured to restore a roughness of polishing pad 20.

During the CMP process, the platen 10, which is rotated by a mechanism, such as a motor (not shown) rotating in a direction. The platen 10 is configured to rotate in at least a first direction (e.g., in a direction D1). In some embodiments, the platen 10 is configured to rotate in more than one direction. In some embodiments, the platen 10 is configured to have a constant rotational speed. In some embodiments, the platen 10 is configured to have a variable rotational speed. In some embodiments, the platen 10 is rotated by a motor through a platen spindle 12. In some embodiments, the motor is an alternating current (AC) motor, a direct current (DC) motor, a universal motor, or any other suitable motor. In other embodiments, the platen 10 is configured to be held stationary.

The platen 10 and the platen spindle 12 are each made of a material having good chemical resistance to the slurry 60. In some embodiments, the platen 10 and the platen spindle 12 are each made of stainless steel or polyetheretherketone (PEEK).

In some embodiments, the platen 10 is configured to translate in one or more directions such that it can apply pressure on the surface of the wafer 40 during the CMP process. In other embodiments, the wafer carrier 30 may push the wafer 40 in a direction against the polishing pad 20, such that the surface of the wafer 40 in contact with the polishing pad 20 may be polished by the slurry 60.

As the platen 10 rotates, the polishing pad is rotated. The platen 10, the polishing pad 20, or both are configured such that the polishing pad 20 rotates in a same direction at a same speed as the platen 10. In embodiments, the polishing pad 20 is removably coupled (e.g., via an adhesive) to the platen 10. In some embodiments where the platen 10 is stationary, the polishing pad 20 is held stationary.

The polishing pad 20 has a textured surface which is configured to remove material from the wafer 40 during operation of the CMP system 100. The polishing pad 20 is formed of a material that is hard enough to allow abrasive particles in the slurry to mechanically polish the wafer 40, which is between the wafer carrier 30 and the polishing pad 20. On the other hand, the polishing pad 20 is soft enough so that it does not substantially scratch surfaces of the wafer 40 it comes in contact with during the polishing process. Further, the polishing pad 20 is made of a material having good chemical resistance to the slurry 60. In some embodiments, the polishing pad 20 is made of polyurethane.

The wafer carrier 30 is configured to hold the wafer 40 proximate to the polishing pad 20 during operation of the CMP system 100. In some embodiments, the wafer carrier 30 includes a retaining ring 32. A carrier film 34 inside of the retaining ring 32 attaches the wafer 40 to the wafer carrier 30.

For further planarization of the wafer 40, the wafer carrier 30 may rotate (e.g., in a direction D1, as shown, or the reverse direction), causing the wafer 40 to rotate, and move on the polishing pad 20 at the same time, but various embodiments of the present disclosure are not limited in this regard. In other words, the wafer carrier 30 is configured to rotate in a second direction. In some embodiments, the second direction is the same as the first direction. In other words, the wafer carrier 30 and the polishing pad 20 rotate in the same direction (e.g., clockwise or counter-clockwise). In some embodiments, the second direction is opposite the first direction. In other words, the wafer carrier 30 and the polishing pad 20 rotate in opposite directions. In some embodiments, the wafer carrier 30 is configured to rotate at a constant rotational speed. In some embodiments, the wafer carrier 30 is configured to rotate at a variable rotational speed. In some embodiments, the wafer carrier 30 is rotated by a motor through the wafer carrier spindle 36. In some embodiments, the motor is an AC motor, a DC motor, a universal motor, or another suitable motor. In other embodiments, the wafer carrier 30 is held stationary. In some embodiments, the wafer carrier 30 translates relative to the polishing pad 20. The wafer carrier 30, the carrier film 34 and the wafer carrier spindle 36 are each made of a material having good chemical resistance to the slurry 60. In some embodiments, the wafer carrier 30 and the wafer carrier spindle 36 are each made of stainless steel or PEEK, and the carrier film 34 is made of polyurethane.

While the CMP system 100 is in operation, the slurry 60 flows between the wafer 40 and the polishing pad 20. The slurry 60 includes reactive chemical(s) that react with the surface layer of the wafer 40, and abrasive particles for mechanically polishing the surface of the wafer 40. Through the chemical reaction between the reactive chemical(s) in the slurry 60 and the surface layer of the wafer 40, and the mechanical polishing, the surface layer of the wafer 40 is removed.

The slurry 60 generally includes abrasive particles in an aqueous solution. In some embodiments, the slurry 60 further includes one or more chemical additives, such as an oxidizing agent, a chelating agent, a corrosion inhibitor, or a pH adjusting agent. The chemical additives help to provide proper modification of metal surfaces to be polished, which helps to improve polishing efficiency.

The abrasive particles mechanically polish the surface of the wafer 40. Examples of abrasive particles include silica ($SiO_2$), alumina ($Al_2O_3$), ceria ($CeO_2$), titania ($TiO_2$), zirconia ($ZrO_2$), magnesia ($MgO$), and manganese oxide ($MnO_2$). In some embodiments, the slurry 60 includes a single type of abrasive particles. In some embodiments, the slurry 60 includes a mixture of two or more types of abrasive particles. For example, in some embodiments, the slurry 60 includes some abrasive particles that are $CeO_2$, and some abrasive particles that are $SiO_2$ or $Al_2O_3$. In some embodiments, to help to obtain good dispersion stability and to minimize the occurrence of scratches, the slurry 60 includes colloidal $SiO_2$, colloidal $Al_2O_3$, colloidal $CeO_2$, or combinations thereof.

To help obtain a favorable polishing rate, the abrasive particles have an average particle size (e.g., average particle diameter) of about 20 nanometer (nm) to about 500 nm. If the size of the abrasive particles is too small, the polishing rate becomes too low for the CMP process to be effective. If the size of the abrasive particles is too great, the chance of generating defects on the wafer 40 surface due to scratching is increased. In some embodiments, the slurry 60 includes abrasive particles of similar sizes. In some implementations, the slurry 60 includes a mixture of abrasive particles of different sizes. For example, in some embodiments, the slurry 60 includes some abrasive particles that have sizes clustered around a smaller value, e.g., less than about 50 nm, and other abrasive particles that have sizes clustered around a larger value, e.g., about 100 nm or more.

The slurry 60 includes any suitable amount of abrasive particles. In some embodiments, the slurry 60 includes about 10 wt. % or less of abrasive particles. In some embodiments, the slurry 60 includes about 0.01 wt. % to about 10 wt. % of abrasive particles. The higher wt. % of the abrasive particles in the slurry 60 normally provides a greater polishing rate. However, if the concentration of the abrasive particles is too high, the abrasive particles agglomerate into large particles that fall out of the solution, rendering the slurry unsuitable for polishing. Thus, the concentration of abrasive particles in the polishing the slurry 60 is set to be as high as practical without causing agglomeration of the abrasive particles.

Optionally, an oxidizing agent is incorporated into the slurry 60 to facilitate efficient removal and better planarization. The oxidizing agent promotes oxidation of metals in a barrier layer and a conductive material layer to corresponding metal oxides, and the metal oxides are subsequently removed by mechanical grinding. For example, an oxidizing agent is used to oxidize tungsten to tungsten oxide; thereafter, the tungsten oxide is mechanically polished and removed. As a further example, the oxidizing agent is able to oxidize copper to cuprous oxide or cupric oxide; thereafter, the cuprous oxide or cupric oxide is mechanically polished and removed. Examples of oxidizing agents include hydrogen peroxide, peroxosulfates, nitric acid, potassium periodate, hypochlorous acid, ozone, ferric nitrate ($Fe(NO_3)_3$), potassium nitrate $K(NO_3)$, and combinations thereof. The slurry 60 includes any suitable amount of oxidizing agent, if present, to ensure rapid oxidation of metal layers while balancing the CMP performance. In some embodiments, the slurry includes about 10 wt. % or less of oxidizing agent. In some embodiments, the slurry includes about 0.01 wt. % to about 10 wt. % of oxidizing agent.

Optionally, a chelating agent is incorporated into the slurry 60 to improve the planarization or polishing of metal surfaces. The chelating agent is capable of forming a complex compound with metal ions, e.g., Cu or W ions, so that oxidized metal is able to be removed from the metal surfaces being polished. Examples of chelating agent include, for example, inorganic acids such as phosphoric acid, organic acids such as acetic acid, oxalic acid, malonic acid, tartaric acid, citric acid, maleic acid, phthalic acid, or succinic acid, and amines such as ethanol amine or propanol amine. The slurry 60 includes any suitable amount of the chelating agent, if present. In some embodiments, the slurry 60 includes about 10 wt. % or less of the chelating agent. In some embodiments, the slurry 60 includes about 0.01 wt. % to about 10 wt. % of the chelating agent.

Optionally, a corrosion inhibitor is incorporated into the slurry 60 to help prevent corrosion of metals during the CMP processes. In some embodiments, the corrosion inhibitor includes a material that is the same as the chelating agent. The slurry includes any suitable amount of a corrosion inhibitor, if present. In some embodiments, the slurry 60 includes 10 wt. % or less of the corrosion inhibitor. In some embodiments, the slurry 60 includes about 0.01 wt. % to about 10 wt. % of the corrosion inhibitor.

Optionally, a pH adjusting agent is incorporated in the slurry 60 to maintain a pH level of the slurry in a range from about 2 to about 11. The pH of the slurry 60 varies depending upon the metals present at the surface to be polished. For example, the pH of the slurry 60 is generally from about 2 to 7 for polishing tungsten and aluminum, while the pH of the slurry is generally from about 7 to 11 for polishing copper, cobalt, and ruthenium. In some embodiments, acids such as hydrochloric acid, nitric acid, sulfuric acid, acetic acid, tartaric acid, succinic acid, citric acid, malic acid, malonic acid, various fatty acids, and various polycarboxylic acids are employed to lower the pH of the slurry. In some embodiments, bases such as potassium hydroxide (KOH), ammonium hydroxide ($NH_4OH$), trimethyl amine (TMA), triethyamine (TEA), and tetramethylammounium hydroxide (TMAH) are employed to increase pH of the slurry. The slurry 60 includes any suitable amount of the pH adjusting agent, if present. In some embodiments, the slurry 60 includes 10 wt. % or less of the pH adjusting agent. In some embodiments, the slurry 60 includes about 0.01 wt. % to about 10 wt. % of the pH adjusting agent.

Certain aforementioned compounds are capable of performing more than one function. For example, some compounds, such as organic acids are capable of functioning as an oxidizing agent, a chelating agent, as well as a pH adjusting agent.

The slurry dispenser 50, which has an outlet 54 over the polishing pad 20, is used to dispense the slurry 60 onto the polishing pad 20. The slurry delivery system 50 further includes a slurry arm 52 configured to translate a location of the outlet 54 relative to the surface of the polishing pad 20. The slurry arm 52 is made of a material having good chemical resistance to the slurry 60. In some embodiments, the slurry arm 52 is made of stainless steel or polyurethane.

A drain cup (not shown) may be disposed around a perimeter of the platen 10. The drain cup is capable of collecting excess slurry 60 that is dispensed onto the polishing pad 20 during CMP processes.

In summary, when the CMP system 100 is in operation, the slurry arm 52 dispenses the slurry 60 onto the polishing surface of the polishing pad 20. A motor, under control of the control system 110, rotates the platen 10 and the polishing pad 20 via the platen spindle 12 about a polishing pad axis, as shown by the arrows D1. Another motor, also under control of the control system 110, rotates the wafer 40 housed within the wafer carrier 30 about a wafer axis via the wafer carrier spindle 36, as shown by the arrows D1. While this dual-rotation occurs, the wafer 40 is "pressed" into the slurry 60 and the polishing surface of the polishing pad 20 with a down force applied to the wafer carrier 30. The combined mechanical force and chemical interactions polishes the surface of the wafer 40 until an endpoint for the CMP operation is reached.

Figure 1B:
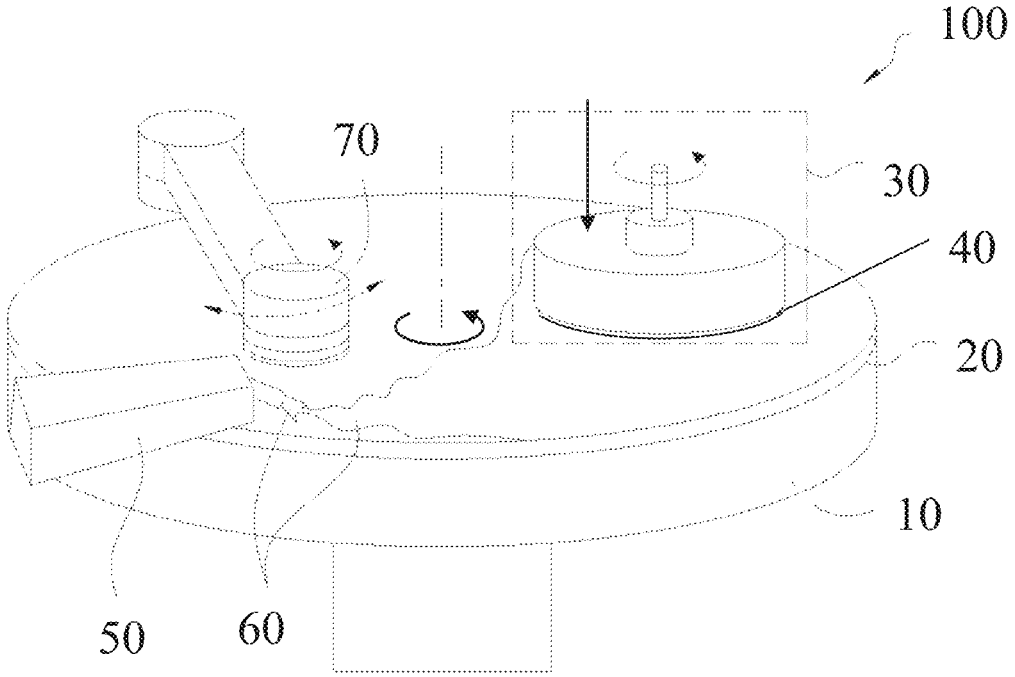

FIG. 1B shows a schematic view of an alternate CMP system 100. As described above with regard to FIG. 1A, the chemical-mechanical polishing system 100 includes the platen 10, the polishing pad 20, the wafer carrier 30, and the slurry dispenser 50. The polishing pad 20 is arranged on the platen 10, and the slurry dispenser 50 and the wafer carrier 30 are present above the polishing pad 20. Additionally, the dressing disk 70 is arranged over the polishing pad 20.

The dressing disk 70 is configured to condition the polishing pad 20 and to remove undesirable by-products generated during the CMP process. The dressing disk 70 is typically made at least partially of an electrically conductive material, such a metal or alloy (e.g., a nickel-chromium alloy), and generally has protrusions or cutting edges that can be used to polish and re-texturize the surface of the polishing pad by strategically damaging the polishing surface during a dressing process. In accordance with some embodiments of the present disclosure, the dressing disk 70 contacts the top surface of the polishing pad 20 when the polishing pad 20 is to be conditioned. During the conditioning process, the polishing pad 20 and the dressing disk 70 are rotated, so that the protrusions or cutting edges of the dressing disk 70 move relative to the surface of the polishing pad 20, to polish and re-texturize the surface of the polishing pad 20. In various embodiments, the polishing pad 20, the dressing disk 70, or both, are rinsed with deionized water before, during, or after the dressing process.

During the CMP process, metal particles (e.g., removed from the surface being planarized by the polishing pad, from the dressing disk, etc.) tend to accumulate on the polishing pad, the dressing disk, or both. As the polishing pad is used, the pores in the surface of the polishing pad become clogged by the metal particles. This drastically reduces the material removal ability of the polishing surface of the polishing pad (e.g., the removal rate and overall efficiency).

During a conditioning process applied to a polishing pad, metals (e.g., nickel, cobalt, iron, magnesium, etc.) dissolve in the slurry and/or in the deionized water used to rinse the dressing disk 70 and/or the polishing pad 20. The dissolved metal then deposits into the pores of the polishing pad 20, on the surface of the dressing disk 70, or both. Unless removed, the metal deposits can be adsorbed by the wafer during the CMP process, thus providing a source of defects on the wafer. In addition, if not removed, the metal deposits can adversely affect the performance of the dressing disk 70 and the polishing pad 20.

Figure 2A:
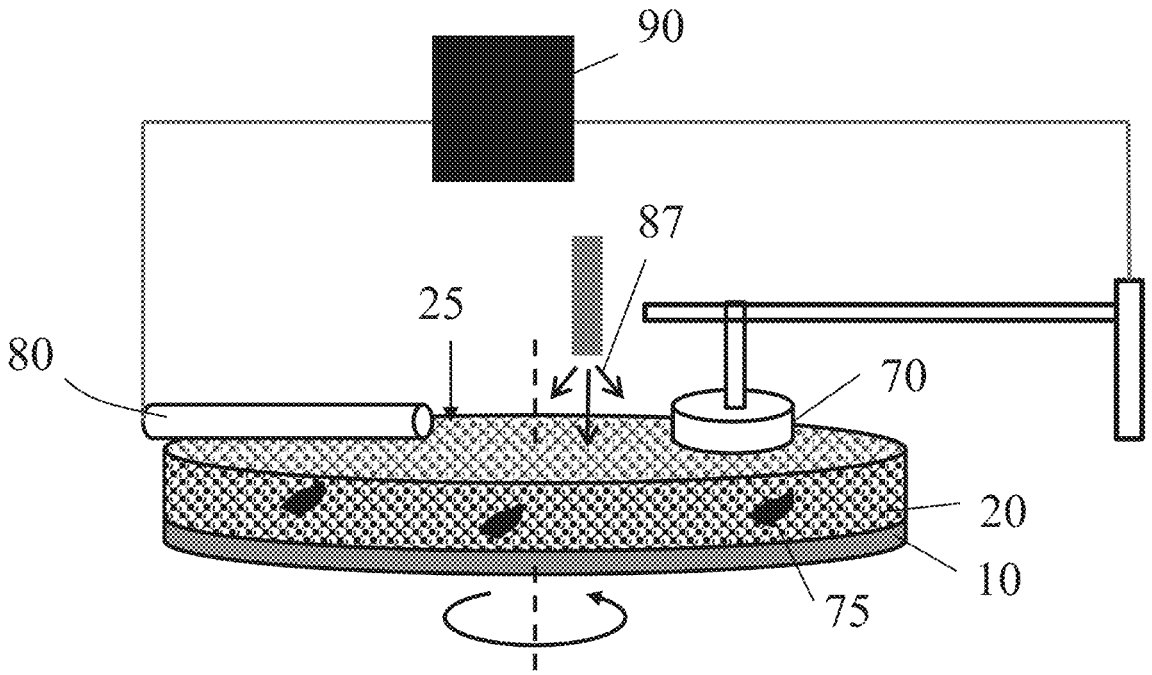
FIGS. 2A-2C are diagrams of a portion of a CMP system in accordance with some embodiments.

In accordance with embodiments of the present disclosure, in order to clean (e.g., to remove the metal deposits 75 from) the polishing pad 20, electrolysis methods are employed during the conditioning process. As shown in FIG. 2A, and in the operation 122 of the flowchart of FIG. 5A, the dressing disk 70 and an electrically conductive element (e.g., the electrically conductive rod 80) contact the polishing surface 25 of the polishing pad 20. As described further above, during the CMP process, the dressing disk 70 presses downward on the polishing surface 25 of the polishing pad 20 as the polishing pad 20 rotates. The downward force of the dressing disk 70 during the conditioning process is sufficient to maintain electrical contact with the electrolytic solution 87 present on the surface of the polishing pad 20, but not so great to cause unnecessary damage to the polishing pad. In some embodiments, the downforce of the dressing disk 70 is at least about 15 Newtons (N). In some embodiments, the downforce of the dressing disk 70 is no more than about 30 N. In some embodiments, the downforce of the dressing disk 70 ranges from about 15 N to about 30 N.

In accordance with some embodiments of the present disclosure, the polishing surface 25 of the polishing pad 20 is also in contact with an electrically conductive element (e.g., the electrically conductive rod 80) during the conditioning process, as shown in FIG. 2A. In some embodiments, the electrically conductive element is electrically conductive and in the shape of a rod. In such embodiments, the electrically conductive rod 80 is configured to rotate/roll as the polishing pad 20 rotates around the axis shown with the dashed line during the conditioning process. In various embodiments, the polishing pad 20 rotates at a speed ranging from 20 revolutions per minute (rpm) to 120 rpm.

As the electrically conductive rod 80 rotates/rolls, it also presses downward (i.e., toward the platen 10) on the polishing pad 20. The downward pressure with which the electrically conductive rod presses on the polishing pad is strong enough to maintain electrical contact between the conductive rod and the electrolytic solution, without inhibiting the movement of, or causing damage to, the polishing pad. The compressibility of the polishing pad 20 may be considered when choosing an appropriate downward force. For example, if the polishing pad 20 is soft, good contact between the electrically conductive rod 80 and the polishing pad 20 can be made by a small amount of force, e.g., 1 hectopascal (hpa) of downward force. In some embodiments, the electrically conductive rod 80 presses downward with a pressure ranging from 1 hpa to 100 hpa. In particular embodiments, the electrically conductive rod 80 presses downward with a pressure ranging from 1 hpa to 30 hpa. In some embodiments, the electrically conductive rod 80 is in contact with the polishing pad 20 with sufficient force so that it is rotated by the rotation of the polishing pad 20. In alternate embodiments, the electrically conductive rod 80 is driven by something other than the polishing pad 20, e.g., a motor.

The electrically conductive element (e.g., the electrically conductive rod 80) may be any suitable size and formed of any suitable electrically conductive material. In various embodiments, the electrically conductive rod 80 has a length ranging from 150 millimeters (mm) to 300 mm. In some embodiments, the electrically conductive rod 80 has a diameter ranging from 10 mm to 30 mm. In specific embodiments, the conductive rod has a length ranging from 200 mm to 300 mm and a diameter ranging from 10 mm to 30 mm.

In various embodiments, the electrically conductive element (e.g., the electrically conductive rod 80) is formed of an electrically conductive material, such as a metal. For example, an electrically conductive element may include Cu, Ni, Ag, Pt, or alloys thereof. In other embodiments, an electrically conductive element includes graphite. Electrically conductive elements useful in accordance with embodiments described herein are not limited to the specific dimensions and specific materials described above. Electrically conductive elements useful in accordance with embodiments described herein can have dimensions falling outside the specific ranges described above and can be formed from electrically conductive materials other than those specifically described above.

Figure 5A:
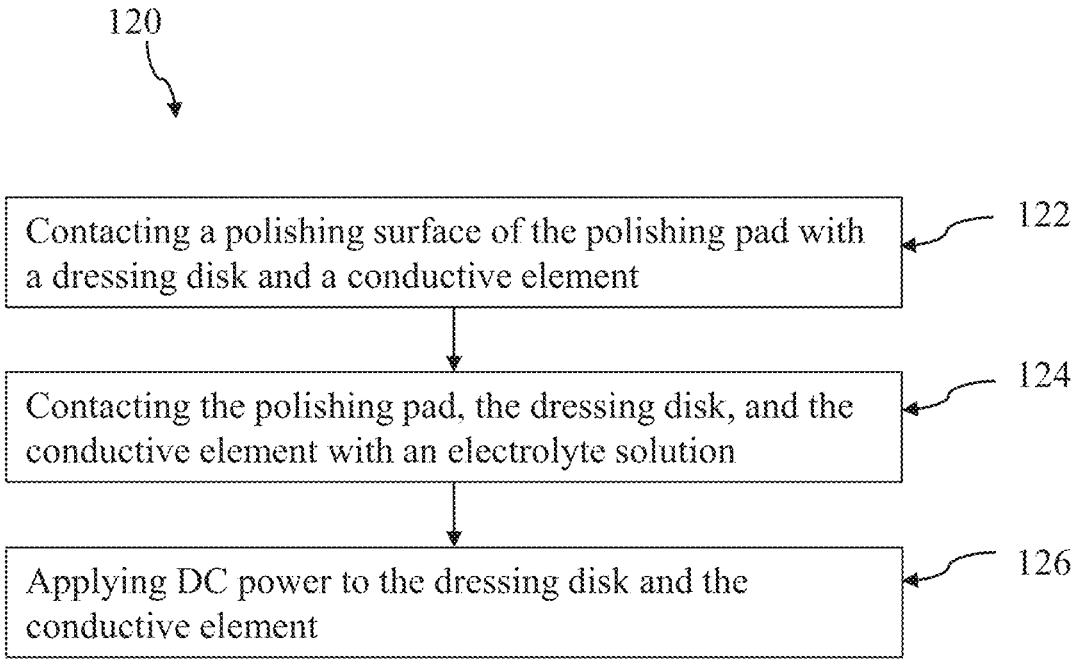
FIGS. 5A and 5B are flowcharts of methods of cleaning a polishing pad and a dressing disk, respectively, in accordance with some embodiments.

In accordance with embodiments of the present disclosure, the electrolytic solution 87 is applied to the polishing surface 25 of the polishing pad 20 while the electrically conductive element (e.g., the electrically conductive rod 80) and the dressing disk 70 are arranged on the polishing surface 25 (the operation 124 of the flowchart of FIG. 5A). In some embodiments, the polishing pad 20 is rinsed with the electrolytic solution 87. Any suitable electrolytic solution 87 may be used. In embodiments, a suitable electrolytic solution has substantially the same pH as the slurry 60 used in the CMP process. "Substantially," as used herein, means that the pH of the electrolytic solution is within ±20% of the pH of the slurry 60 used. In embodiments, substantially means that the pH of the electrolytic solution is within ±10% of the pH of the slurry 60 used. In embodiments, substantially means that the pH of the electrolytic solution is within ±5% of the pH of the slurry 60 used. In particular embodiments, the pH of the electrolytic solution is within ±1% of the pH of the slurry 60 used.

In various embodiments, the electrolytic solution 87 includes a metal salt. In particular embodiments, the metal salt is NaCl, $Zn_2SO_4$, $CuSO_4$, or a combination thereof. In some such embodiments, the molar concentration of the metal salt ranges from 0.05 Molar (M) to 5 M. In some embodiments, the electrolyte solution further includes soluble acids. In certain embodiments, the soluble acid includes $H_2SO_4$. In further embodiments, the electrolyte solution includes soluble bases. In particular embodiments, the soluble base includes NaOH, KOH, or both. Electrolyte solutions useful in accordance with embodiments described herein are not limited to those having a pH within the specific ranges described above or the specific metal salts, soluble acids and soluble bases described above. Embodiments of the present disclosure include electrolyte solutions that have a pH falling outside the specific ranges describe above, and metal salts, soluble acids or soluble bases other than the specific metal salts, soluble acids or soluble bases described above.

In accordance with embodiments described herein, DC power is applied to the dressing disk 70 and the electrically conductive element (e.g., the electrically conductive rod 80) by the DC power source 90 (the operation 126 of the flowchart of FIG. 5A). When the DC power is applied, the dressing disk 70 acts as a cathode (negative bias) and the electrically conductive element (e.g., the electrically conductive rod 80) acts as an anode (positive bias) to perform electrolysis in the electrolyte solution. The metal deposits 75 on the polishing pad 20 are thus oxidized and dissolved into solution. In other words, the metal in the metal deposits 75 on the polishing pad 20 loses electrons, resulting in a cation that will associate with an anion in the electrolyte solution. The metal from the metal deposits 75 may then deposit in a zero valence state onto the dressing disk as cations are reduced at the dressing disk.

Any suitable DC power source that can provide the DC power with voltage and current in the desired range can be used. In some embodiments, the DC power applied has a voltage ranging from 0.5 volts (V) to 60V. In some embodiments, the DC power applied has a voltage ranging from 0.5 volts (V) to 20V. In particular embodiments, the DC power applied has a voltage of about 4V. In some embodiments, the DC power applied has a working current ranging from 0.1 amperes (A) to 20 A. In some embodiments, the DC power applied has a working current ranging from 0.1 amperes (A) to 10 A. In particular embodiments, the DC power applied has a working current of about 3 A. DC power sources useful in accordance with embodiments described herein include DC power sources capable of operating within the specific voltage ranges and the specific current ranges described above. DC power sources useful in accordance with embodiments described herein also include DC power sources capable of operating outside the specific voltage ranges in the specific current ranges described above.

Accordingly, methods of the present disclosure include a method 120 for cleaning a polishing pad, the method comprising: contacting a polishing surface of the polishing pad with a dressing disk and an electrically conductive element (the operation 122); contacting the polishing pad, the dressing disk, and the electrically conductive element with an electrolyte solution (the operation 124); and applying DC power to the dressing disk and the electrically conductive element (the operation 126).

Figure 2B:
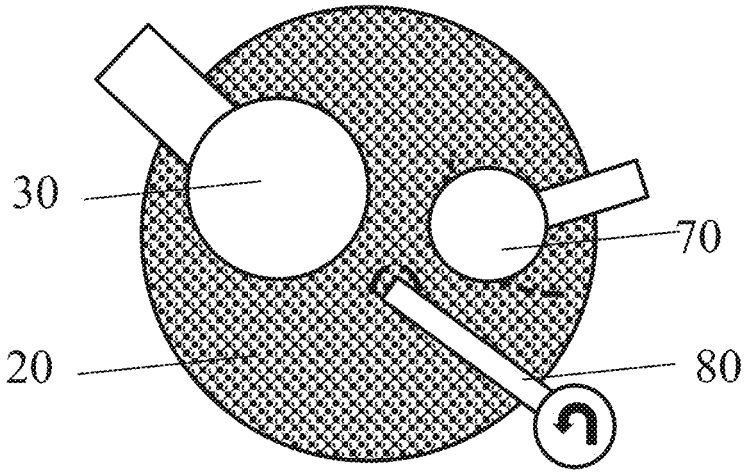

An alternate view of the system shown in FIG. 2A is shown in FIG. 2B. Although the wafer carrier 30 is pictured, the wafer carrier 30 is not in contact with the polishing pad 20 during the conditioning process.

Figure 2C:
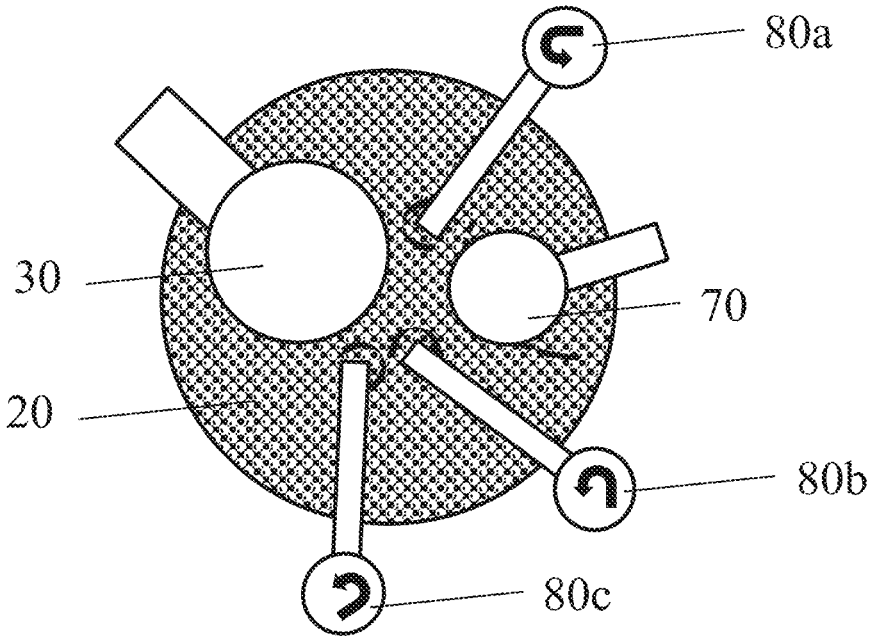

In further embodiments of the present disclosure, more than one electrically conductive element is present. For example, as shown in FIG. 2C, the electrically conductive rods 80*a*, 80*b*, 80*c* are in contact with the polishing surface of the polishing pad 20 and rotate as the polishing pad 20 rotates. The electrically conductive rods 80*a*, 80*b*, 80*c* are coupled to a DC power source, which applies the DC power to the conductive rods 80*a*, 80*b*, 80*c* and the dressing disk 70. Although three electrically conductive rods are shown in the present embodiment, any suitable number of electrically conductive elements may be present. In some embodiments the number of electrically conductive elements ranges from 1 to 6.

Figure 3:
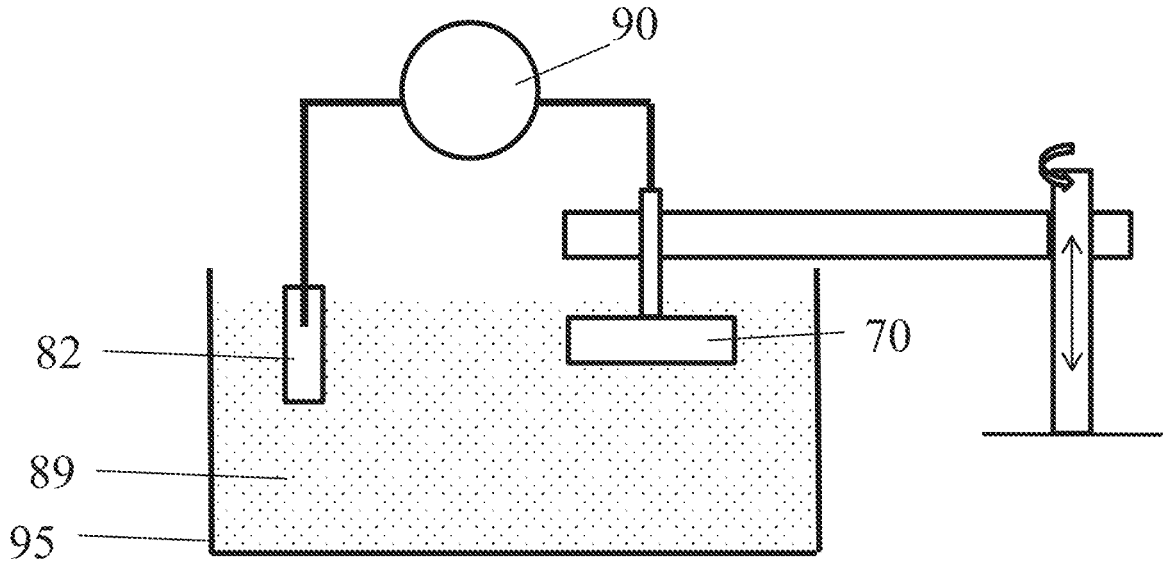
FIG. 3 is a diagram of a portion of a CMP system in accordance with some embodiments.
Figure 5B:
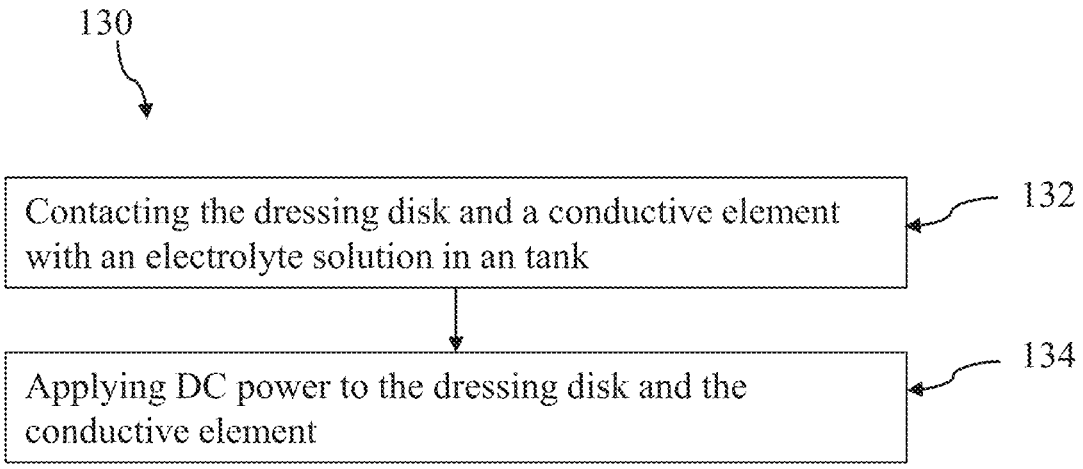

Further embodiments of the present disclosure include methods for cleaning the dressing disk 70, as illustrated in FIG. 5B. In some embodiments, such methods are used when the dressing disk 70 returns to a home position, as shown in FIG. 3. In accordance with embodiments, the dressing disk 70 and an electrically conductive element (e.g., the electrically conductive bar 82) are arranged in the tank 95 that houses the electrolytic solution 89.

The electrically conductive element (e.g., the electrically conductive bar 82) can be formed in any suitable shape. In some embodiments, the electrically conductive element is an electrically conductive rod. In other embodiments, the electrically conductive element is the electrically conductive bar 82. In some embodiments, the electrically conductive element (e.g., the electrically conductive bar 82) includes a metal. For example, an electrically conductive element may include Cu, Ni, Ag, Pt, or alloys thereof. In particular embodiments, the electrically conductive element is stainless steel. In other embodiments, an electrically conductive element may include graphite.

The electrolytic solution 89 contacts the dressing disk 70 and the electrically conductive element (e.g., the electrically conductive bar 82) in the tank 95 (the operation 132 of the flowchart of FIG. 5B). In embodiments, the dressing disk 70 and the electrically conductive element (e.g., the electrically conductive bar 82) are at least partially submerged in the electrolytic solution 89.

Any suitable electrolytic solution 89 may be used. In some embodiments, a suitable electrolytic solution 89 has substantially the same pH as the slurry 60 used in the CMP process. In other embodiments where the electrolysis (by electrolytic solution) is separated from polishing (by slurry), the pH of the slurry 60 used in the CMP process is substantially different from the pH of the electrolytic solution 89.

In some embodiments, the electrolytic solution 89 includes salt(s). In some embodiments, the salt includes $NaCO_3$, NaCl, $Zn_2SO_4$, $CuSO_4$, or a combination thereof. In particular embodiments, the salt includes $NaCO_3$. In various embodiments, the molar concentration ranges from 0.05 Molar (M) to 5 M. In some embodiments, the electrolytic solution 89 includes soluble acids. In certain embodiments, the soluble acid includes $H_2SO_4$. In further embodiments, the electrolytic solution 89 includes soluble bases. In particular embodiments, the soluble base includes NaOH, KOH, or both. Electrolytic solutions useful in accordance with embodiments described herein include the specific metal salts, soluble acids and soluble bases described above. Embodiments of the present disclosure include electrolytic solutions that include metal salts, soluble acids or soluble bases other than the specific metal salts, soluble acids or soluble bases described above.

In accordance with embodiments described herein, while the dressing disk 70 and the electrically conductive element (e.g., the electrically conductive bar 82) are arranged in the tank 95 and in contact with the electrolytic solution 89, the DC power is applied to the dressing disk 70 and the electrically conductive element (e.g., the electrically conductive bar 82) by the DC power source 90 (the operation 134 of the flowchart of FIG. 5B).

Accordingly, methods of the present disclosure include the method 130 for cleaning a dressing disk, the method comprising: contacting the dressing disk and an electrically conductive element with an electrolyte solution in a tank (the operation 132); and applying DC power to the dressing disk and the electrically conductive element (the operation 134).

When the DC power is applied, the dressing disk 70 acts as an anode (positive bias) and the electrically conductive element (e.g., the electrically conductive bar 82) acts as a cathode (negative bias). In such embodiments, metal particles on the dressing disk are oxidized and released into the electrolytic solution 89, thereby cleaning the dressing disk 70. In other words, the metal on the dressing disk loses electrons, resulting in a cation that associates with an anion in the electrolyte solution.

Any suitable DC power source that can provide DC power with voltage and current in the desired range can be used. In some embodiments, the DC power source 90 is the same power source described above. In other embodiments, the DC power source 90 is a second, different power source. In some embodiments, the DC power applied has a voltage ranging from 0.5 volts (V) to 20V. In some embodiments, the DC power applied has a working current ranging from 0.1 amperes (A) to 10 A. In particular embodiments, the DC power applied has a working current of about 3 A. DC power sources useful in accordance with embodiments described herein include DC power sources capable of operating within the specific voltage ranges and the specific current ranges described above. DC power sources useful in accordance with embodiments described herein further include DC power sources capable of operating outside the specific voltage ranges in the specific current ranges described above.

Figure 4:
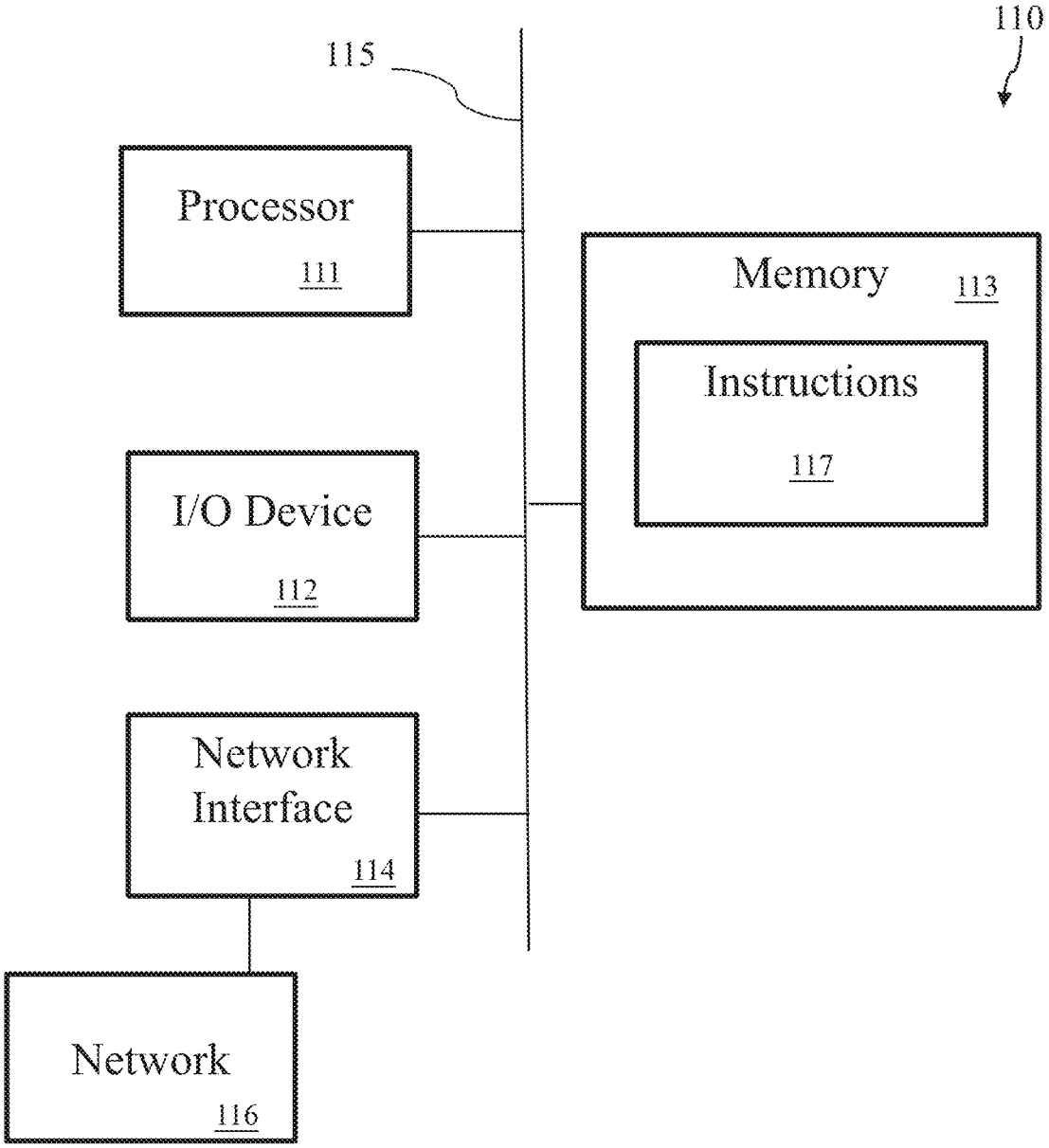
FIG. 4 is a diagram of a control system for controlling operation of a CMP system, in accordance with some embodiments.

FIG. 4 is a block diagram of the control system 110 for controlling operation of a CMP system, in accordance with one or more embodiments. The control system 110 generates output control signals for controlling operation of one or more components of the CMP system, in accordance with some embodiments. The controller system 110 receives input signals from one or more components of the CMP system, in accordance with some embodiments. In some embodiments, the control system 110 is located adjacent CMP system. In some embodiments, the control system 110 is remote from the CMP system.

The control system 110 includes the processor 111, the input/output (I/O) device/interface 112, the memory 113, and the network interface 114 each communicatively coupled via the bus 115 or other interconnection communication mechanism.

The processor 111 is arranged to execute and/or interpret the instructions 117 stored in the memory 113. In some embodiments, the processor 111 is a central processing unit (CPU), a multi-processor, a distributed processing system, an application specific integrated circuit (ASIC), and/or a suitable processing unit.

The I/O interface 112 is coupled to external circuitry. In some embodiments, the I/O interface 112 includes a keyboard, keypad, mouse, trackball, trackpad, and/or cursor direction keys for communicating information and commands to the processor 111.

The memory 113 (also referred to as computer-readable medium) includes a random access memory or other dynamic storage device, communicatively coupled to the bus 115 for storing data and/or instructions for execution by the processor 111. In some embodiments, the memory 113 is used for storing temporary variables or other intermediate information during execution of instructions to be executed by the processor 111. In some embodiments, the memory 113 also includes a read-only memory or other static storage device coupled to the bus 115 for storing static information and instructions for the processor 111. In some embodiments, the memory 113 is an electronic, magnetic, optical, electromagnetic, infrared, and/or a semiconductor system (or apparatus or device). For example, the memory 113 includes a semiconductor or solid-state memory, a magnetic tape, a removable computer diskette, a random access memory (RAM), a read-only memory (ROM), a rigid magnetic disk, and/or an optical disk. In some embodiments using optical disks, the memory 113 includes a compact disk-read only memory (CD-ROM), a compact disk-read/write (CD-R/W), and/or a digital video disc (DVD).

The memory 113 is encoded with, i.e., storing, the computer program code, i.e., the set of executable instructions 117, for controlling one or more components of the CMP system and causing the control system 110 to perform the CMP processes. In some embodiments, the memory 113 also stores information needed for performing the CMP processes as well as information generated during performing the CMP process.

The network interface 114 includes a mechanism for connecting to the network 116, to which one or more other computer systems are connected. In some embodiments, the network interface 114 includes a wired and/or wireless connection mechanism. The network interface 114 includes wireless network interfaces such as BLUETOOTH, WIFI, WIMAX, GPRS, or WCDMA; or wired network interface such as ETHERNET, USB, or IEEE-1394. In some embodiments, the control system 110 is coupled with one or more components of the CMP system via the network interface 114. In some embodiments, the control system 110 is directly coupled with one or more components of the CMP system, e.g., with the components coupled to the bus 115 instead of via the network interface 114.

In various embodiments, the control system 110 causes the CMP system to perform a cleaning protocol (e.g., as described above and shown in FIGS. 5A and 5B) periodically. For example, the control system 110 may initiate cleaning of the polishing pad, dressing disk, or both, after a predetermined number (e.g., 5, 10, 20, 50, 100, etc.) of the CMP processes. In other embodiments, the control system 110 initiates cleaning of the polishing pad, dressing disk, or both, at predetermined time intervals (e.g., daily, weekly, monthly, etc.). In further embodiments, a user input causes the control system 110 to initiate the cleaning of the polishing pad, dressing disk, or both, The methods of cleaning the polishing pad and/or the dressing disk of the present disclosure extend the lifetime of polishing pads due to reduced metal deposits. Further, the methods result in fewer defects on the wafers polished.

Thus, a polishing pad cleaned with the described methods has a longer pad lifetime than a polishing pad that has not been cleaned with the described methods (e.g., a polishing pad using the same material and having the same nap thickness). Accordingly, a polishing pad of the disclosure may be used to polish more pieces with substantially the same polishing efficiency than a polishing pad that has not been cleaned with the described methods.

Additionally, the methods described herein result in a polishing pad that has a more stable (i.e., less variable) polishing efficiency than a polishing pad that has not been cleaned with the described methods due to the reduction in glazing of the polishing pad. Additionally, the methods of the present disclosure result in reduced residue from cleaners remaining on the polishing pad and/or dressing disk, which further prevents glazing of the polishing pad. In other words, embodiments of the disclosure provide for a polishing pad that has a more stable remove rate than a polishing pad that has not been cleaned with the described methods.

Accordingly, the pad lifetime of the polishing pad is significantly increased, and a stable, high removal rate is maintained for a longer period of time compared to a polishing pad that has not been cleaned with the described methods.

Embodiments of the present disclosure include a method for cleaning a polishing pad that includes contacting the polishing surface of the polishing pad with a dressing disk and an electrically conductive element, bringing the polishing pad, the dressing disk, and the electrically conductive element in contact with an electrolyte solution, and applying DC power to the dressing disk and the electrically conductive element, thereby removing metal particles from the polishing pad and depositing the metal particles on the dressing disk by electrolysis in the first electrolyte solution.

Further embodiments of the present disclosure include a method for removing metal deposits present on a dressing disk that includes contacting a polishing pad with a dressing disk, rotating the polishing pad, positioning the dressing disk in a tank, contacting the dressing disk and a first electrically conductive element with a first electrolyte solution in the tank, and applying DC power to the dressing disk and the first electrically conductive element, thereby removing metal particles from the dressing disk and by electrolysis in the first electrolyte solution.

Additional embodiments of the present disclosure include a CMP system that includes a polishing pad that has a polishing surface, a dressing disk in contact with the polishing surface, a first electrically conductive element in contact with the polishing surface, a first electrolyte solution in contact with the dressing disk and the first electrically conductive element, and a DC power supply electrically coupled to the dressing disk and the first electrically conductive element configured to apply DC power to the dressing disk and the first electrically conductive element.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A method for cleaning a polishing pad, the method comprising:

contacting a polishing surface of the polishing pad with a dressing disk and a first electrically conductive element;

contacting the polishing pad, the dressing disk, and the first electrically conductive element with a first electrolyte solution; and applying a direct current (DC) power to the dressing disk and the first electrically conductive element, thereby removing metal particles from the polishing pad and depositing the metal particles on the dressing disk by electrolysis in the first electrolyte solution.

2. The method of claim 1, further comprising:

positioning the dressing disk in a tank with a second electrically conductive element;

contacting the dressing disk and the second electrically conductive element with a second electrolyte solution; and applying a DC power to the dressing disk and the second electrically conductive element.

3. The method of claim 2, wherein the contacting the dressing disk and the second electrically conductive element with the second electrolyte solution comprises submerging the dressing disk and the second electrically conductive element in the second electrolyte solution.

4. The method of claim 1, wherein the first electrically conductive element is an electrically conductive rod.

5. The method of claim 4, wherein the contacting the polishing surface comprises rotating the polishing pad and rolling the electrically conductive rod on the polishing surface of the polishing pad.

6. The method of claim 5, wherein the contacting the polishing pad, the dressing disk, and the first electrically conductive element with the first electrolyte solution comprises supplying the first electrolyte solution during the rotating the polishing pad and the rolling the electrically conductive rod.

7. The method of claim 6, wherein the supplying the first electrolyte solution comprises spraying the first electrolyte solution onto the polishing pad.

8. The method of claim 1, wherein the DC power is applied to the dressing disk and the first electrically conductive element while the first electrolyte solution is in contact with the polishing pad, the dressing disk, and the first electrically conductive element.

9. A chemical mechanical planarization (CMP) system, comprising:

a polishing pad that has a polishing surface;

a dressing disk in contact with the polishing surface;

a first electrically conductive element in contact with the polishing surface;

a first electrolyte solution in contact with the dressing disk and the first electrically conductive element; and a direct current (DC) power supply electrically coupled to the dressing disk and the first electrically conductive element configured to apply a DC power to the dressing disk and the first electrically conductive element.

10. The CMP system of claim 9, further comprising:

a tank that is configured such that the dressing disk can be positioned at least partially in the tank; and a second electrolyte solution housed in the tank.

11. The CMP system of claim 9, wherein the first electrolyte solution comprises $NaCO_3$, NaCl, $Zn_2SO_4$, $CuSO_4$, or a combination thereof.

12. The CMP system of claim 11, wherein the first electrolyte solution further comprises a soluble acid.

13. The CMP system of claim 11, wherein the first electrolyte solution further comprises a soluble base.

14. The CMP system of claim 9, wherein the first electrically conductive element comprises Cu, Ni, Ag, Pt, or alloys thereof.

15. The CMP system of claim 9, further comprising a plurality of electrically conductive elements, wherein the first electrically conductive element is one of the plurality of electrically conductive elements.

16. A method, comprising:

contacting a polishing surface of a polishing pad with a dressing disk and at least one first electrically conductive element;

conditioning the polishing surface of the polishing pad using the dressing disk;

supplying a first electrolyte solution to the polishing surface of the polishing pad, the polishing pad and the at least one first electrically conductive element in contact with the first electrolyte solution; and performing an electrolysis reaction by applying a first direct current (DC) power to the dressing disk and the at least one first electrically conductive element with the dressing disk acting as a cathode and the at least one first electrically conductive element acting as an anode, thereby removing metal particles from the polishing pad by dissolving the metal particles in the first electrolyte solution.

17. The method of claim 16, further comprising:

rotating the polishing pad about an axis; and rotating or rolling the at least one first electrically conductive element as the polishing pad rotates.

18. The method of claim 16, further comprising:

immersing the dressing disk and a second electrically conductive element in a second electrolyte solution; and applying a second DC power to the dressing disk and the second electrically conductive element with the dressing disk acting as an anode and the second electrically conductive element acting as a cathode, thereby removing metal from the dressing disk.

19. The method of claim 16, further comprising polishing a surface of a wafer by the polishing pad with a slurry.

20. The method of claim 19, wherein the first electrolyte solution has substantially the same pH as the slurry.

* * * * *